US011281122B2

(12) United States Patent
Shoshani et al.

(10) Patent No.: US 11,281,122 B2
(45) Date of Patent: Mar. 22, 2022

(54) VOLTAGE CONTROL IN A LIQUID ELECTROPHOTOGRAPHIC PRINTER

(71) Applicant: Hewlett-Packard Development Company, L.P., Spring, TX (US)

(72) Inventors: Asaf Shoshani, Ness Ziona (IL); Lavi Cohen, Ness Ziona (IL); Shachar Berger, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/755,927

(22) PCT Filed: Dec. 14, 2017

(86) PCT No.: PCT/US2017/066354
§ 371 (c)(1),
(2) Date: Apr. 14, 2020

(87) PCT Pub. No.: WO2019/117910
PCT Pub. Date: Jun. 20, 2019

(65) Prior Publication Data

US 2021/0208521 A1 Jul. 8, 2021

(51) Int. Cl.
*G03G 15/06* (2006.01)
*G03G 15/11* (2006.01)

(52) U.S. Cl.
CPC ..... *G03G 15/065* (2013.01); *G03G 15/11* (2013.01)

(58) Field of Classification Search
CPC ... G03G 15/065; G03G 15/11; G03G 15/1675
(Continued)

(56) References Cited

U.S. PATENT DOCUMENTS 4,161,361 A * 7/1979 Soma ..... G03G 15/11 399/249
5,132,738 A 7/1992 Nakamura et al.
(Continued)

FOREIGN PATENT DOCUMENTS

| | | |
|---|---|---|
| JP | 2003195710 A | 7/2003 |
| JP | 2006243047 | 9/2006 |
| WO | WO-2016119849 A1 | 8/2016 |

OTHER PUBLICATIONS

Forrest, D.J. et al., Print Quality Analysis as a Qc Tool for Manufacturing Inkjet Print Heads, 1999, http://www.imaging.org/site/PDFS/Papers/1999/RP-0-92/2085.pdf.

*Primary Examiner* — Hoan H Tran
(74) *Attorney, Agent, or Firm* — HP Inc. Patent Department

(57) ABSTRACT

A method of printing images in a liquid electrophotographic printer is provided. In an example, the method includes measuring at least one current associated with an image development unit of the liquid electrophotographic printer. A first time at which a peak occurs in the measured current is determined; the first time indicates that a printing substance is transferred from a point on a developer roller of the image development unit to a photo imaging member of the liquid electrophotographic printer at a first location within the image development unit. A second time at which said point on the developer roller is expected to contact the cleaner roller within the image development unit is calculated and, at the second time, a voltage applied to the cleaner roller is controlled to reduce the potential difference between the cleaner roller and the developer roller.

15 Claims, 6 Drawing Sheets

(58) Field of Classification Search
USPC ..... 399/38, 53, 55, 222, 237, 240
See application file for complete search history.

(56) References Cited

U.S. PATENT DOCUMENTS

| | | | | |
|---|---|---|---|---|
| 5,179,397 | A | 1/1993 | Ohzeki et al. | |
| 7,469,109 | B2 | 12/2008 | Shibuya | |
| 8,290,404 | B2 | 10/2012 | Raz | |
| 8,953,972 | B2 | 2/2015 | Izawa et al. | |
| 9,829,825 | B2 * | 11/2017 | Fujihara ..... | G03G 15/0266 |

* cited by examiner

VOLTAGE CONTROL IN A LIQUID ELECTROPHOTOGRAPHIC PRINTER

BACKGROUND

An electrophotographic printing system may use digitally controlled lasers to create a latent image in the charged surface of a photo imaging plate (PIP). The lasers may be controlled according to digital instructions from a digital image file. Digital instructions typically include one or more of the following parameters: image color, image spacing, image intensity, order of the color layers, etc. A printing substance may then be applied to the partially-charged surface of the PIP, recreating the desired image. The image may then be transferred from the PIP to a transfer blanket on a transfer member and from the transfer blanket to the desired substrate, which may be placed into contact with the transfer blanket by an impression cylinder. The printing substance may be applied to the surface of the PIP from one or more Binary Ink Developer (BID) units.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

Figure 1:
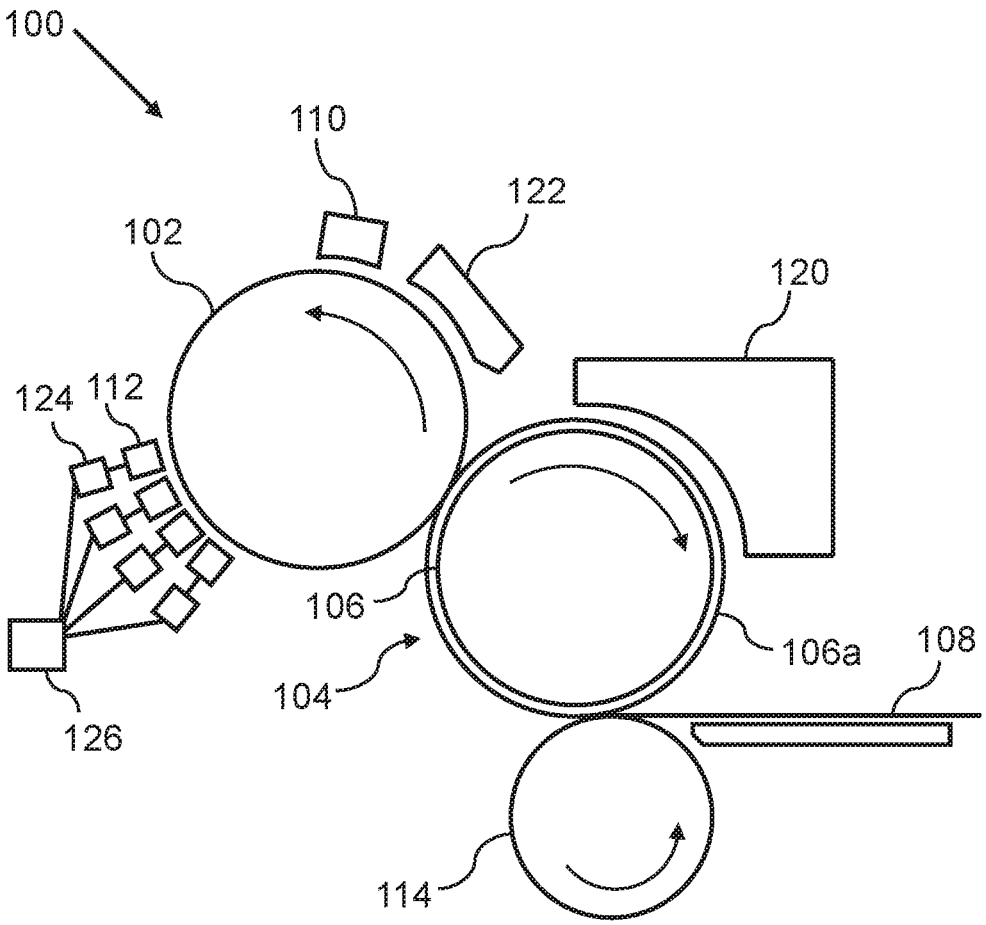
FIG. 1 is a schematic diagram showing a liquid electrophotographic printer in accordance with an example.

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Electrophotographic printing refers to a process of printing in which a printing substance (e.g., a liquid or dry electrophotographic ink or toner) can be applied onto a surface having a pattern of electrostatic charge. The printing substance conforms to the electrostatic charge to form an image in the printing substance that corresponds to the electrostatic charge pattern.

In some electrographic printers, a printing substance may be transferred onto a photo imaging member by one or more Binary Ink Developer (BID) units. In some examples, the printing substance may be liquid ink. In other examples the printing substance may be other than liquid ink, such as toner. In some examples, there may be one BID unit for each printing substance and/or printing substance color. During printing, the appropriate BID unit can be engaged with the photo imaging member. The engaged BID unit may present a uniform film of printing substance to the photo imaging member.

The printing substance may comprise electrically charged pigment particles that are attracted to oppositely charged electrical fields on the image areas of the photo imaging member. The printing substance may be repelled from the charged, non-image areas. The result may be that the photo imaging member is provided with the image, in the form of an appropriate pattern of the printing substance, on its surface. In other examples, such as those for black and white (monochromatic) printing, one or more BID units may alternatively be provided.

Particles of a printing substance may be referred to generally as ink particles (including particles in a liquid ink). Ink particles in the printer may be electrically charged such that they can be controlled when subjected to an electric field. Typically, the ink particles may be negatively charged and therefore repelled from the negatively charged portions of the photo imaging member, and attracted to the discharged portions of the photo imaging member.

BID units may comprise one or more electrodes to provide an electric field in order to provide electric charge to the ink particles. An electric field is generated between a rotatable developer roller of the BID and the electrodes, which causes electrically charged ink to develop on the developer roller. Once the electrically charged ink has been transferred from the developer roller to the photo imaging member, residual developed ink is electrically removed from the developer roller using a cleaner roller.

A certain print quality defect, referred to as a "PQ set defect" or "PQ set phenomenon", can occur when a solid line is to be printed to a substrate. At the point at which the developer roller transfers ink to the photo imaging member (referred to as the "PIP nip"), there is a sudden change in the ink layer thickness on the developer roller (e.g. as the "line" is transferred from within a layer of ink on the developer roller, leaving a line-shaped indent in the layer). As the developer roller continues to rotate, the point of sudden change in the ink layer thickness reaches a location at which the ink is to be electrically cleaned away by the cleaner roller (the "cleaner-developer nip"). The ink layer acts as a resistor; therefore, the sudden drop in residual ink thickness results in a drop in electrical resistance. There is a corresponding sudden change in the developer roller and the cleaner roller currents, as the electric field between the developer roller and the cleaner roller remains constant. This results in a sudden change in the electrical properties of the developer roller surface and a corresponding high field area at the PIP nip, causing an unintended ink transfer between the developer roller and the PIP. The resulting, unintended solid line that is printed to the substrate is the PQ set defect. This unintended line may appear as a "ghost" artefact, e.g. comprise a faint printed line that is visible by eye.

FIG. 1 shows an example of a liquid electrophotographic (LEP) printer 100, for use with BID units of the present disclosure, to print a desired image. A desired image may be initially formed on a photoconductor using a printing substance, such as liquid ink. In the example shown, the photoconductor is a photo imaging member 102 in the form of a rotatable cylinder, but in other examples the photoconductor may be a photoconductive plate, belt, or other conductive element. The printing substance, in the form of the image, may then be transferred from the photo imaging member 102 to an intermediate surface, such as the surface of a transfer member 104. The photo imaging member 102 may continue to rotate, passing through various stations to form the next image.

In the example depicted in FIG. 1, the transfer member 104 can comprise a transfer drum or cylinder 106 and a transfer blanket 106*a* surrounding the transfer cylinder 106, and the surface of the transfer member 104 can be a surface of the transfer blanket 106*a*. In other examples, transfer member 104 may comprise a continuous belt supporting a transfer blanket, or a continuous transfer blanket belt (wherein the transfer blanket is not disposed on a supporting member).

According to one example, an image may be formed on the photo imaging member 102 by rotating a clean, bare segment of the photo imaging member 102 under a photo charging unit 110. The photo charging unit 110 may include a charging device, such as corona wire, charge roller, or other charging device, and a laser imaging portion, A uniform static charge may be deposited on the photo imaging member 102 by the photo charging unit 110. As the photo imaging member 102 continues to rotate, the photo imaging member 102 can pass the laser imaging portion of the photo charging unit 110, which may dissipate localized charge in selected portions of the photo imaging member 102, to leave an invisible electrostatic charge pattern that corresponds to the image to be printed. In some examples, the photo charging unit 110 can apply a negative charge to the surface of the photo imaging member 102. In other examples, the charge may be a positive charge. The laser imaging portion of the photo charging unit 110 may then locally discharge portions of the photo imaging member 102, resulting in local neutralized regions on the photo imaging member 102.

In this example, a printing substance may be transferred onto the photo imaging member 102 by one or more Binary Ink Developer (BID) units 112. At least one voltage source 124 can be provided to each BID unit, and these can be controlled by a controller 126. In some examples, the printing substance may be liquid ink. In other examples the printing substance may be other than liquid ink, such as toner. In this example, there may be one BID unit 112 for each printing substance color. During printing, the appropriate BID unit 112 can be engaged with the photo imaging member 102. The engaged BID unit 112 may present a uniform film of printing substance to the photo imaging member 102.

In this example, following the provision of the printing substance on the photo imaging member 102, the photo imaging member 102 may continue to rotate and transfer the printing substance, in the form of the image, to the transfer member 104. In some examples, the transfer member 104 can also be electrically charged to facilitate transfer of the image to the transfer member 104.

Once the photo imaging member 102 has transferred the printing substance to the transfer member 104, the photo imaging member 102 may rotate past a cleaning station 122 which can remove any residual ink and cool the photo imaging member 102 from heat transferred during contact with the hot blanket. At this point, in some examples, the photo imaging member 102 may have made a complete rotation and can be recharged ready for the next image.

In some examples, the transfer member 104 may be disposed to transfer the image directly from the transfer member 104 to the substrate 108. In some examples, where the electrophotographic printer is a liquid electrophotographic printer, the transfer member 104 may comprise a transfer blanket 106*a* to transfer the image directly from the transfer blanket to the substrate 108. In other examples, a transfer component may be provided between the transfer member 104 and the substrate 108, so that the transfer member 104 can transfer the image from the transfer member 104 towards the substrate 108, via the transfer component.

In this example, the transfer member 104 may transfer the image from the transfer member 104 to a substrate 108 located between the transfer member 104 and an impression member, such as an impression cylinder 114. This process may be repeated, if more than one colored printing substance layer is to be included in a final image to be provided on the substrate 108.

Figure 2:
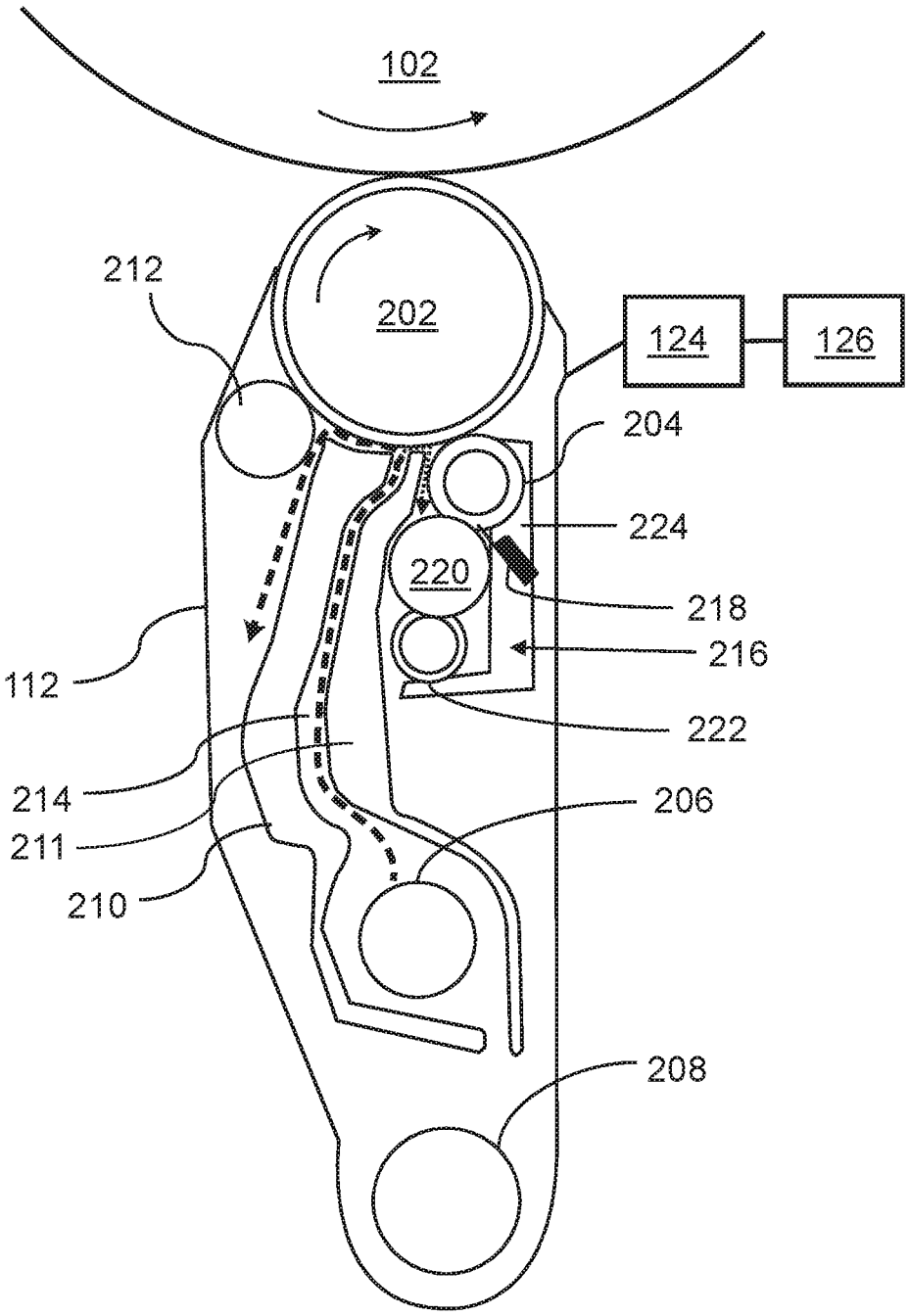
FIG. 2 is a schematic diagram showing a binary ink development unit in accordance with an example.

FIG. 2 shows an example BID unit 112 for use in the LEP printer 100 of FIG. 1. A developer roller 202 transfers printing fluid onto the photo imaging member 102. After the transfer, a cleaner roller 204 removes residual printing fluid from the developer roller 202.

The BID unit 112 may comprise, for example, an ink inlet 206, an ink outlet 208, a developer electrode (having a main electrode 210 and a back electrode 211) and a squeegee roller 212.

In use, the BID unit 112 may receive ink from an ink tank (not pictured) through inlet 206. The ink supplied to the BID unit 112 (also referred to as undeveloped ink) may comprise about 3% non-volatile solids by volume, such as about 3% ink particles by volume. The ink tank may be arranged separately from the BID unit 112 in an electrophotographic printer, and may be connected to inlet 206 by a conduit (not pictured). The ink supplied to the BID unit 112 may travel through it as shown by the dashed arrow. Firstly, the ink may pass through channel 214 in the developer electrode, which may cause some of the ink particles to become charged. The entire ink flow reaches the top of the channel 214, and approximately 80% of the ink flow then continues to flow in the thicker dashed line direction between the developer roller 202 and the main electrode 210, wherein some of the charged particles may be developed onto the surface of the developer roller 202. The remaining 20% of the ink that reaches the top of the channel 214 flows along the thinner dashed line between the photo imaging member 202 and the back electrode 211 to the cleaning unit 216. The ink disposed on the surface of the developer roller 202 may then be dispersed into a layer of more uniform thickness by the squeegee roller 212 (both mechanically and electrostatically), and then transferred to the photo imaging member 102. The ink disposed on the surface of the developer roller 202 (also referred to as developed ink) may comprise about 20% non-volatile solids by volume, such as about 20% ink particles by volume.

The BID unit 112 may also comprise a cleaning unit 216, which may include the cleaner roller 204, a wiper 218, a sponge roller 220, and a squeezer roller 222. The wiper may be supported by a wiper wall 224 in the cleaning unit 216. The cleaning unit 216 may be arranged such that, in use, residual developed ink left on the developer roller 202 after ink has been transferred to the photo imaging member 102 may be transferred to the cleaning roller 204. Additionally, the remaining 20% of the ink that reaches the top of the channel 214 flows between the photo imaging member 202 and the back electrode 211 to the cleaning unit 216. The remaining undeveloped ink can be mixed with the residual developed ink. This is referred to as "ink remixing".

The sponge roller 220 may remove ink from the surface of the cleaning roller 204, and then the squeezer roller 222 may remove ink from the sponge roller 220. Wiper 218 may also be used to ensure that portions of the surface of the cleaning roller 204 are substantially free of ink before contacting the developer roller 202 again. Ink which is not transferred to the developer roller 202, including any remixed ink, may flow out through ink outlet 208 and return to the ink tank (not pictured).

FIG. 2 also shows the voltage source 124 and controller 126 that are connected to the BID unit 112. The voltage source 124 selectively applies a voltage to the cleaner roller 204. The voltage source 124, or separate voltage sources (not shown), may also be provided to other components of the BID unit 112, such as the developer roller 202, squeegee roller 212 and the electrode 210. In an example, each element of the BID unit 112 has its own associate power supply. The controller 126 may comprise a microprocessor and a memory. The LEP printer 100 may comprise electronic circuitry to receive a control signal from the microprocessor and, in response, to cause the voltage source to adjust the voltage applied to the cleaner roller 204, as explained further below with reference to FIGS. 3*a* and 3*b*.

Figure 3A:
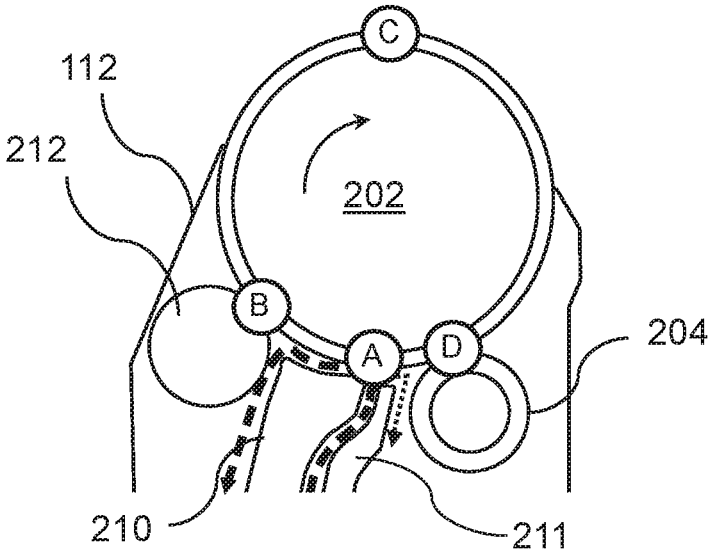
FIG. 3*a* is a schematic diagram showing certain components of a binary ink development unit in accordance with an example.

FIG. 3*a* is a more detailed view of the developer roller 202 within a BID unit 112. Ink is transferred to the developer roller at location A and the ink flow splits, as explained with reference to FIG. 2; approximately 80% of the ink flow passes along the thicker dashed line to the main electrode and squeegee roller area, towards location B. When a solid line of ink is transferred to the photo imaging member 102 from the developer roller 202 surface during printing, there is a sudden change in the thickness of the ink layer upon the surface of the developer roller at location C, where it passes or contacts the photo imaging member 102. Location C can be referred to as the "developer-PIP nip". The point on the developer roller 202 surface at which the sudden change in thickness occurs rotates around to location D, where the developer roller 202 contacts or passes the cleaner roller 204. Location D can be referred to as the "cleaner-developer nip", and at this stage any residual ink present on the developer is electrically cleaned away from the developer roller 202 surface by the cleaner roller 204. Ink that is present on the developer roller 202 acts as a resistor, so the presence of a relatively thick layer of ink results in a relatively high electrical resistance, while the presence of a relatively thin layer of ink results in a relatively low electrical resistance between the developer roller 202 and the cleaner roller 204. A constant electric field exists between the developer roller 202 and the cleaner roller 204; therefore, as the point on the developer roller 202, at which the thickness of the ink layer upon the surface suddenly changes, reaches location C, a sudden decrease in the electrical resistance results in a sudden increase in the current between the developer roller 202 and the cleaner roller 204.

Figure 3B:
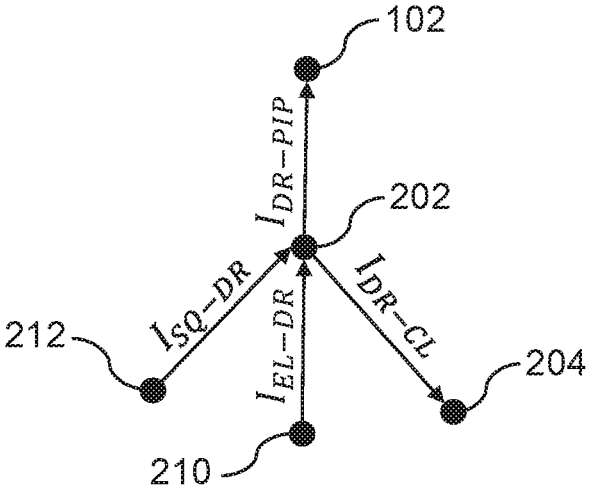
FIG. 3*b* is a diagram showing the electrical currents present in the binary ink development unit of FIG. 3*a;*

FIG. 3*b* shows the electrical current states present in the BID unit 112, in which the developer roller 202 acts as a "current junction". It will be appreciated that:

$$0=I_{SQ\text{-}DR}+I_{EL\text{-}DR}-I_{DR\text{-}CL}-I_{DR\text{-}PIP}$$

where $I_{SQ\text{-}DR}$ is the current between the squeegee roller 212 and the developer roller 202, $I_{EL\text{-}DR}$ is the current between the electrode 210 and the developer roller 202, $I_{DR\text{-}CL}$ is the current between the developer roller 202 and the cleaner roller 204, and $I_{DR\text{-}PIP}$ is the current between the developer roller 202 and the photo imaging member 102. $I_{EL\text{-}DR}$ and $I_{SQ\text{-}DR}$ are constant because each of the voltage differences and the thickness of the layer of ink at locations A and B, respectively, are constant. Therefore, when $I_{DR\text{-}CL}$ increases, the electrical properties of the developer roller surface change, and as a result $I_{DR\text{-}PIP}$ decreases. As a result, a high electric field area occurs locally at location C, and ink is unintentionally developed from the developer roller 202 onto the photo imaging member 102. This unintended ink transfer is the PQ set phenomenon, which appears as a shadow or ghost image on the printed substrate; therefore, $I_{DR\text{-}PIP}$ can be considered to be a "trigger current", as the decrease in this current acts as a warning that a PQ set defect may occur. PQ set defects are most noticeable after printing solid lines, such as frames, because of the distinctive and contrasting nature of the printed image. In an example where the linear velocity of the photo imaging member 102 is ~2.3 $ms^{-1}$, the time taken for the point at which the thickness of the ink layer on the developer roller changes to travel from location C to location D is ~43 ms. This results in a PQ set defect that appears 100 mm after the intentionally printed image on the print substrate, such as a solid line. In order to counteract the PQ set defect, the controller 126 is provided to measure a current of the developer roller 202; the current measured may be the developer roller current with respect to the photo imaging member 102, i.e. $I_{DR\text{-}PIP}$. However, in practice, it may be difficult to track and measure currents through the photo imaging member, which is a current junction. Therefore, the developer roller current measured may be the developer roller current with respect to ground, i.e. $I_{DR\text{-}G}$. In practice, measuring the currents of each of the components, such as the developer roller 202, the electrode 210, cleaner roller 204 and the squeegee roller 212 relative to ground allows the relative current between the developer roller and the photo imaging member, $I_{DR\text{-}PIP}$, to be calculated or inferred. The controller 126 determines a first time (e.g. t=0 ms) at which a peak occurs in the measured current. The peak may be determined by a processor that is able to determine a sudden gradient increase in the $I_{DR\text{-}G}$ current. The start of this increase in the current gradient, as determined by the programmed settings of the processor, determines the start of the peak, while the end of the peak is similarly determined by the point at which the current gradient reduces to its initial value and the current is substantially constant (therefore, the "peak" in the current is not defined by the instantaneous maximum current value). The first time indicates that ink is transferred from a point on the developer roller 202 to the photo imaging member 102 at a first location (e.g. location C) within the image development unit. The controller 126 then calculates a second time (e.g. t=43 ms) at which the point on the developer roller 202 is expected to contact the cleaner roller 204 (e.g. at location D). The controller can calculate the second time based on an angular velocity of the developer roller 202 and an angular distance between location C and location D (at which the developer roller contacts the cleaner roller).

Therefore, the increase in developer roller current that is measured, or otherwise determined, at t=0 ms allows a prediction of the second time at which the PQ set defect will occur. At the second time, the controller 126 controls or adjusts the voltage applied to the cleaner roller 204 to reduce the potential difference between the cleaner roller 204 and the developer roller 202. In an example, the cleaner roller 204 voltage is increased in order to reduce the potential difference between the cleaner roller 204 and the developer roller 202, as one or more of the voltages applied are negative voltages. Alternatively, the cleaner roller voltage may be controlled indirectly, for example by implementing a feedback control system to keep $I_{DR\text{-}CL}$ constant. In an example, the cleaner roller 204 voltage is adjusted so that the potential difference is reduced from, for example, 200V to between 30V and 70V. In another example, the cleaner roller 204 voltage is adjusted so that the potential difference is reduced to approximately 50V. The exact potential difference that the controller 126 adjusts the cleaner roller 204 voltage to obtain, should be chosen to balance the risk of other phenomena occurring; the adjustment should be large enough to address the PQ set defect, but too large an adjustment in the cleaner roller 204 voltage may result in electrical discharge, which can shorten the lifetime of the cleaner roller 204.

The controller may also determine the period of time for which the cleaner roller 204 voltage should be adjusted in order to address the PQ set defect. The controller can determine a duration of the current peak to indicate a first period of time during which the printing fluid is transferred from the point on the developer roller 202 to the photo imaging member 102 of the LEP printer 100. The controller 126 can then adjust the voltage applied to the cleaner roller 204 for a second period of time that is based on the first period of time. The second period of time may be similar or equal to the first period of time. Therefore, monitoring the developer roller 202 current change, which indicates, for example, the duration for which a solid line is being printed, may provide a prediction of the duration of time for which the cleaner roller 204 voltage may be adjusted to counteract the PQ set defect that is likely to occur. The cleaner roller 204 voltage may then be adjusted back to its original voltage level by the controller 126 at the end of the second period of time.

Figure 4:
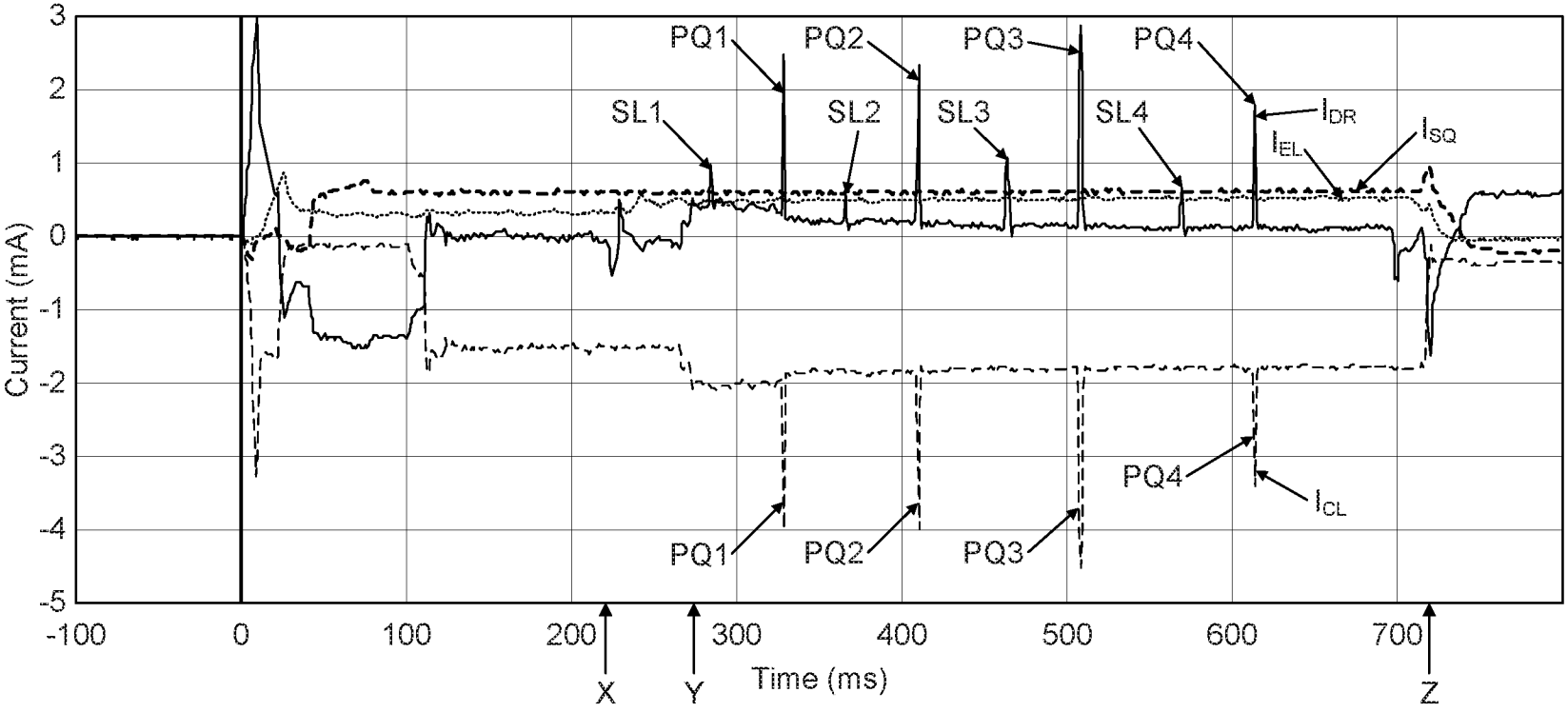
FIG. 4 is a graph showing an example of the electrical currents present when solid lines are printed by a binary ink development unit.

FIG. 4 shows an example of current measurements within an example BID unit 112, in which all of the currents shown are measured relative to the ground. As explained above, measuring some of the respective BID unit component currents relative to ground may provide an acceptably accurate measurement that is more practical to measure than some of the relative currents between the components of the BID unit 112. Examples of the developer roller 202 current ($I_{DR}$), the electrode 210 current ($I_{EL}$), the squeegee roller 212 current ($I_{SQ}$) and the cleaner roller 202 current ($I_{CL}$) values over time are illustrated. Before time X, as indicated on the horizontal axis of FIG. 4, the BID unit 112 and photo imaging member 102 are disengaged from one another, and no transfer of printing fluid or ink is taking place. Between times X and Y, the BID unit 112 and the photo imaging member 102 are brought into contact and can be said to be "just touching". Between times Y and Z, the BID unit 112 and the photo imaging member 102 are said to be fully engaged, transfer of printing fluid can occur, and the controller 126 can monitor or measure one or more currents of elements within the BID unit 112.

As can be seen in FIG. 4, the peak SL1 in the developer roller current $I_{DR}$ indicates that a sudden change in the layer of printing fluid on the surface of the developer roller 202 takes place, for example, the printing of a solid line by transfer of printing fluid from the developer roller 202 to the photo imaging member 102. Similarly, peaks SL2, SL3 and SL4 indicate the printing of second, third and fourth solid lines, respectively, during a print cycle. The controller 126 can be programmed to recognise a sudden change in the current gradient, indicating the start of each of the peaks. The width of the peaks SL1-SL4 can be measured by the controller 126, and indicate the first period of time, for each respective solid line printed, during which the printing fluid is transferred from the point on the developer roller 202 to the photo imaging member 102. In an example, the width of the current peak SL3 is greater than the other current peak widths, indicating that printing fluid is transferred from the developer roller 202 to the photo imaging member 102 for a longer period of time, and that this third peak results in a thicker printed solid line than the first, second or fourth solid lines when printed to a print substrate.

Additional peaks in the developer roller current $I_{DR}$ and corresponding peaks in the cleaner roller current $I_{CL}$, which represent the sudden increase in $I_{DR-CL}$ that occurs when the point of change in the developer roller 202 printing fluid thickness reaches the cleaner-developer nip (i.e. location D of FIG. 3*a*), are indicated by PQ1-PQ4. In the context of the example explained above with reference to FIGS. 3*a* and 3*b*, the PQ peaks occur 43 ms after each of their corresponding SL peaks, resulting in a PQ set defect occurring approximately 100 mm after each printed solid line on the print substrate. Adjusting the cleaner roller 204 voltage as described above, in order to reduce the potential difference between the cleaner roller 204 and the developer roller 202 during each of the PQ peak times, can reduce or eliminate these PQ peaks and the resulting PQ defect.

In an example, the voltage applied to the cleaner roller 204 can be adjusted for a second period of time that is based on the first period of time. In the example of FIG. 4, this adjustment time can be substantially equal to each respective first period of time, that is, the time duration of each peak in the developer roller current $I_{DR}$ level; adjusting the cleaner roller 204 voltage during these times will result in a reduction, or elimination, of the peaks PQ1-PQ4 seen in FIG. 4, and hence a reduction or elimination of the resulting PQ set defect that may otherwise appear on the print substrate.

Figure 5:
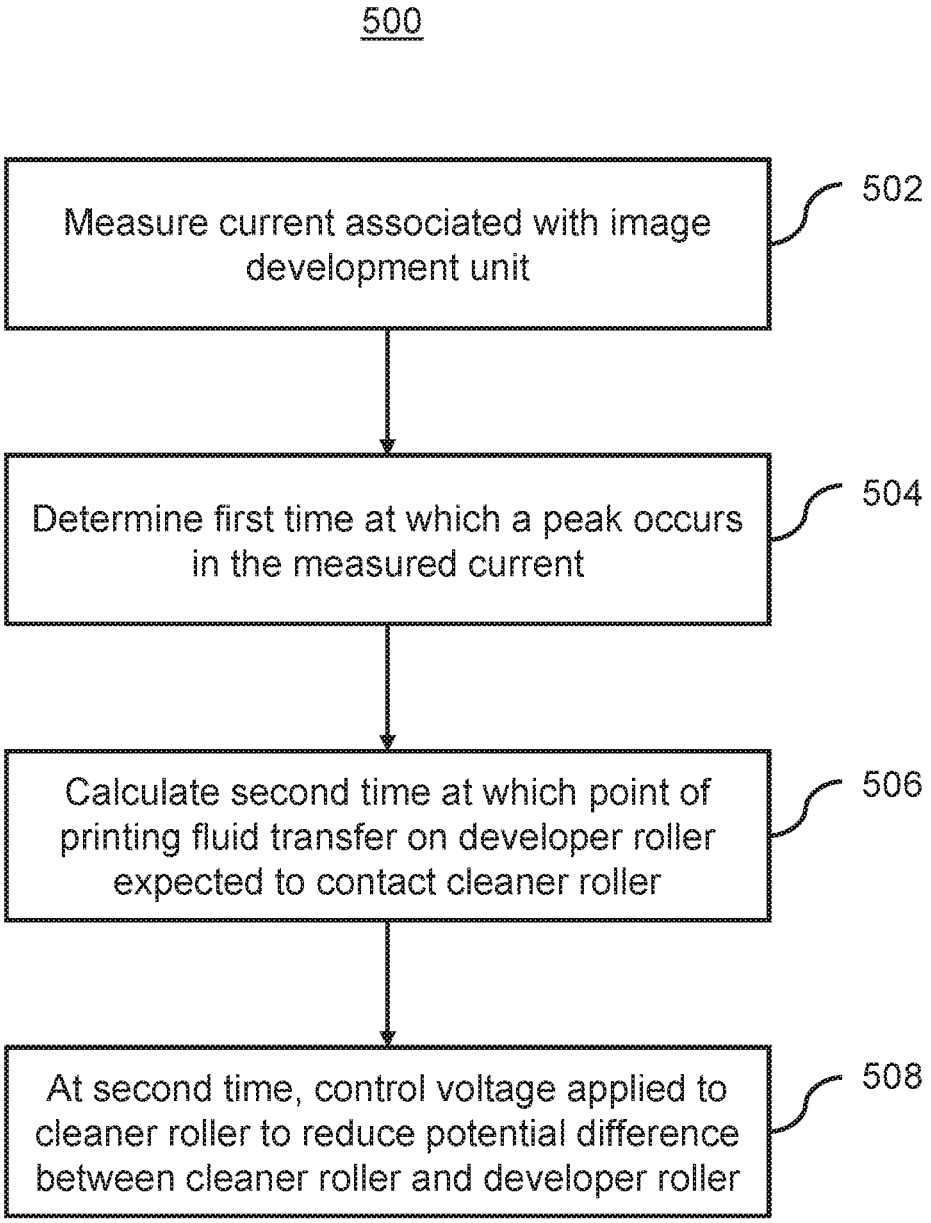
FIG. 5 is a flow diagram showing a method of printing images in a liquid electrophotographic printer, according to an example.

FIG. 5 is a flow diagram showing an example method of printing images in the LEP printer of FIG. 1. At block 502, a current associated with an image development unit, such as a BID unit 112, is measured. The current measured may be the developer roller current with respect to the photo imaging member 102, i.e. $I_{DR-PIP}$. Alternatively, the developer roller current measured with respect to ground may act as a trigger current, while the value of the relative current between the developer roller 202 and the photo imaging member 102, $I_{DR-PIP}$, can be inferred from measurements of each of the developer roller current with respect to ground, the cleaner roller current with respect to ground, the squeegee roller current with respect to ground and the electrode current with respect to ground. At block 504, a first time, at which a peak occurs in the measured current, is determined. The peak may be determined by an increase in the gradient of a current being monitored, such as an increase in the rate of change of $I_{DR-G}$. The first time indicates that printing fluid is transferred from a point on the developer roller 202 to a photo imaging member 102 of the LEP printer 100 at a first location within the BID unit 112.

At block 506, a second time is calculated at which the point on the developer roller 202 is expected to contact a cleaner roller 204 within the BID unit 112. At block 508, at the second time, a voltage applied to the cleaner roller 204 is controlled to reduce the potential difference between the cleaner roller 204 and the developer roller 202.

Figure 6:
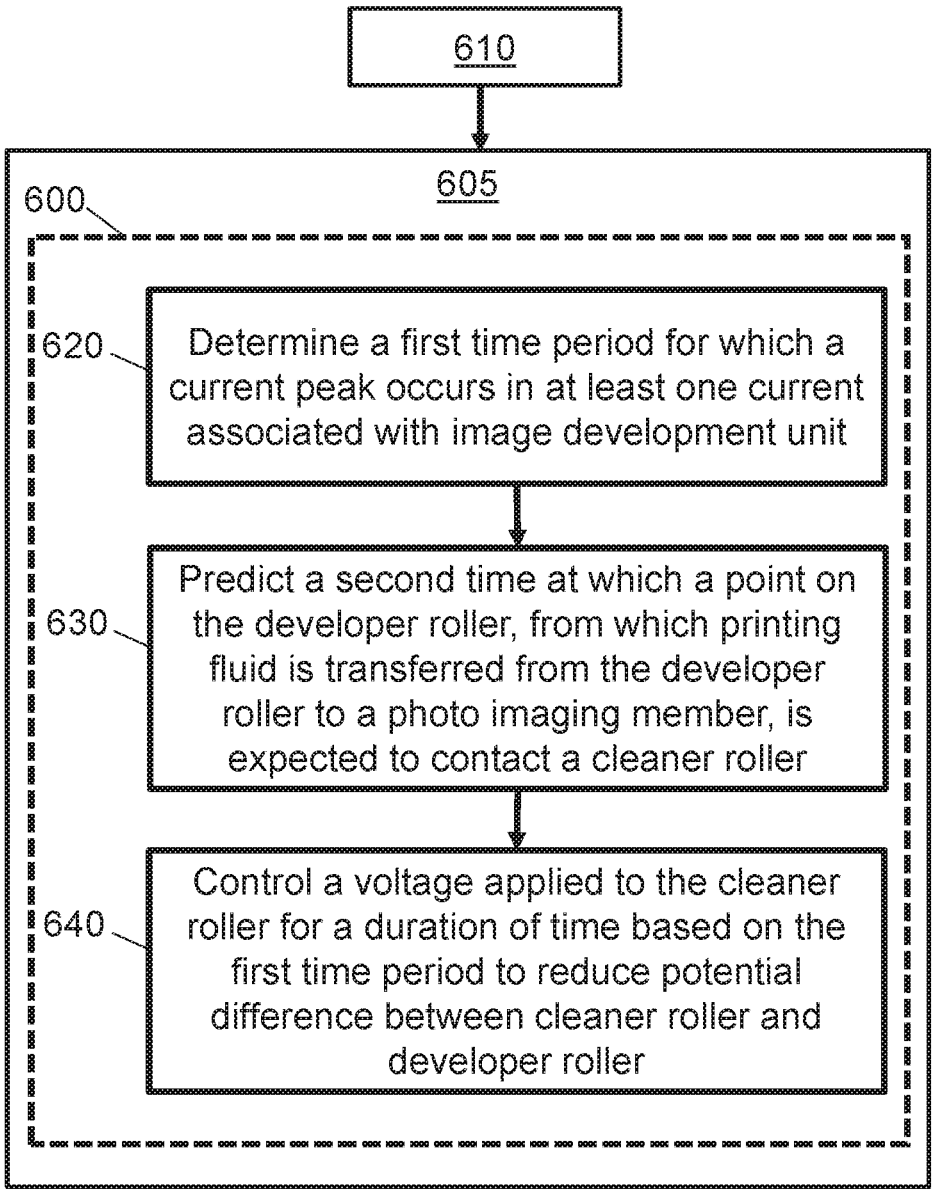
FIG. 6 is a non-transitory computer readable storage medium comprising a set of computer-readable instructions to be carried out by a processor, according to an example.

Referring to FIG. 6, an example of a non-transitory computer readable storage medium 605 may comprise a set of computer-readable instructions 600 stored thereon. The instructions are executed by a processor 610 which may form part of the controller 126 of the example LEP printer 100 of FIG. 1. The instructions are executed by the processor 610 and cause it to carry out the illustrated tasks. At block 620, the processor 610 determines a first time period for which a current peak occurs in at least one current associated with an image development unit 112 of the LEP printer. The first time period indicates that printing fluid is transferred from a point on the developer roller 202 to a photo imaging member 102 of the LEP printer 100 at a first location within the image development unit 112. At block 630, the processor 610 predicts a second time at which said point on the developer roller 202 is expected to contact a cleaner roller within the image development unit. At block 640, at the second time, the processor 610 controls a voltage applied to the cleaner roller 204 for a duration of time based on the first time period to reduce the potential difference between the cleaner roller 204 and the developer roller 202.

The processor 610 may be provided to, in determining the first time period, measure a current $I_{DR-PIP}$ of the developer roller 202 with respect to the photo imaging member 102; however, in practice, this measurement may be difficult to obtain, so $I_{DR-PIP}$, can be inferred from measurements of each of the developer roller current with respect to ground, the cleaner roller current with respect to ground, the squeegee roller current with respect to ground and the electrode current with respect to ground.

Alternatively or additionally, the processor 610 may be provided to, in determining the first time period defined above, analyse image data corresponding to an image to be developed by the LEP printer 100. In analysing the image data, the processor may determine the first time period for each of one or more layers of printing fluid to be transferred from the developer roller 202 to the photo imaging member 102 during development of the image by the LEP printer 100. In an example, image data corresponding to or representing one or more images to be printed can be input into the processor 610. The image data may be obtained by one or more image analysis techniques. The processor may then run one or more software programs to split the image data into portions of data representing each color separation of the image to be printed. After the image has been split into color separations, an image processing tool can be run to detect a solid line in the print and calculate when it will happen and for how long. This data can then be sent to the controller to generate computer code comprising instructions, including instructions 600 of FIG. 6, with which the processor may carry out printing of the analysed image to reduce or eliminate the PQ set defect.

While certain examples have been described above in relation to liquid electrophotographic printing, other examples can be applied to dry electrophotographic printing.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A method of printing images in a liquid electrophotographic printer, the method comprising:

measuring at least one current associated with an image development unit of the liquid electrophotographic printer;

determining a first time at which a peak occurs in the measured current, the first time indicating that a printing substance is transferred from a point on a developer roller of the image development unit to a photo imaging member of the liquid electrophotographic printer at a first location within the image development unit:

calculating a second time at which said point on the developer roller is expected to contact a cleaner roller within the image development unit; and at the second time, controlling a voltage applied to the cleaner roller to reduce the potential difference between the cleaner roller and the developer roller.

2. The method of claim 1, wherein said calculating of the second time at which said point on the developer roller is expected to contact the cleaner roller is based on:

(i) an angular velocity of the developer roller, and (ii) an angular distance between the first location and a second location at which the developer roller contacts the cleaner roller.

3. The method of claim 1, wherein controlling the voltage comprises adjusting the voltage applied to the cleaner roller to reduce the potential difference between the cleaner roller and the developer roller.

4. The method of claim 1, comprising:

determining a duration of the current peak to indicate a first period of time during which the printing substance is transferred from the point on the developer roller to the photo imaging member of the liquid electrophotographic printer;

wherein controlling the voltage applied to the cleaner roller comprises adjusting said voltage for a second period of time that is based on the first period of time.

5. The method of claim 4, wherein the voltage applied to the cleaner roller is adjusted from a first voltage level to a second voltage level during the second period of time, the method comprising:

adjusting the voltage to the first level at the end of the second period of time.

6. A liquid electrophotographic printer comprising:

a photo imaging member; and at least one image development unit having a developer roller to transfer a printing substance onto the photo imaging member and a cleaner roller to remove residual printing substance from the developer roller after said transfer;

a voltage source to selectively apply a voltage to the cleaner roller; and a controller to:

measure at least one current associated with the image development unit;

determine a first time at which a peak occurs in the measured current, the first time indicating that printing substance is transferred from a point on the developer roller to the photo imaging member at a first location within the image development unit:

calculate a second time at which said point on the developer roller is expected to contact the cleaner roller; and at the second time, adjust the voltage applied to the cleaner roller to reduce the potential difference between the cleaner roller and the developer roller.

7. The liquid electrophotographic printer of claim 6, wherein the controller comprises a microprocessor and a memory.

8. The liquid electrophotographic printer of claim 7, comprising electronic circuitry to receive a control signal from the microprocessor and, in response, to cause the voltage source to adjust the voltage applied to the cleaner roller.

9. The liquid electrophotographic printer of claim 6, wherein the controller is provided to calculate the second time at which said point on the developer roller is expected to contact the cleaner roller is based on:

(i) an angular velocity of the developer roller, and (ii) an angular distance between the first location and a second location at which the developer roller contacts the cleaner roller.

10. The liquid electrophotographic printer of claim 6, wherein the controller is provided to increase the voltage applied to the cleaner roller to reduce the potential difference between the cleaner roller and the developer roller.

11. The liquid electrophotographic printer of claim 6, wherein the controller is provided to:

determine a duration of the current peak to indicate a first period of time period during which the printing substance is transferred from the point on the developer roller to the photo imaging member of the liquid electrophotographic printer; and adjust the voltage applied to the cleaner roller for a second period of time that is based on the first period of time.

12. A non-transitory computer readable storage medium comprising a set of computer-readable instructions stored thereon, which, when executed by a processor, cause the processor to, in a liquid electrophotographic printer:

determine a first time period for which a current peak occurs in at least one current associated with an image development unit of the liquid electrophotographic printer, wherein the first time period indicates that a printing substance is transferred from a point on a developer roller to a photo imaging member of the liquid electrophotographic printer at a first location within the image development unit;

predict a second time at which said point on the developer roller is expected to contact a cleaner roller within the image development unit; and at the second time, control a voltage applied to the cleaner roller for a duration of time based on the first time period to reduce the potential difference between the cleaner roller and the developer roller.

13. The non-transitory computer readable storage medium of claim 12, wherein the processor is provided to, in determining the first time period, determine a current between the developer roller and the photo imaging member of the liquid electrophotographic printer.

14. The non-transitory computer readable storage medium of claim 12, wherein the processor is provided to, in determining the first time period, analyse image data corresponding to an image to be developed by the liquid electrophotographic printer.

15. The non-transitory computer readable storage medium of claim 14, wherein the processor is provided to, in analysing the image data, determine the first time period for each of one or more layers of printing substance to be transferred from the developer roller to the photo imaging member during development of the image by the liquid electrophotographic printer.

* * * * *